US005729461A

United States Patent [19]

D'Andrea et al.

[11] Patent Number: 5,729,461

[45] Date of Patent: Mar. 17, 1998

[54] POSTAGE METERING SYSTEM INCLUDING MEANS FOR CONTROLLING THE RESOLUTION OF PRINTING A PORTION OF A POSTAGE INDICIA

[75] Inventors: Thomas A. D'Andrea, Middlebury; Edward J. Naclerio, Madison, both of Conn.

[73] Assignee: Pitney Bowes Inc., Stamford, Conn.

[21] Appl. No.: 554,207

[22] Filed: Nov. 6, 1995

[51] Int. Cl.[6] ..... G07B 17/00

[52] U.S. Cl. ..... 364/464.18; 101/71; 364/464.2; 395/135

[58] Field of Search ..... 101/71; 364/401 R, 364/406, 464.02, 464.03, 464.11, 464.18, 464.2; 395/135

[56] References Cited

U.S. PATENT DOCUMENTS

| | | | |
|---|---|---|---|
| 3,599,564 | 8/1971 | Walbel | 101/109 |
| 3,869,986 | 3/1975 | Hubbard | 101/91 |
| 4,493,252 | 1/1985 | Clark | 101/71 |
| 4,813,912 | 3/1989 | Chickneas et al. | 364/464.02 |
| 4,858,138 | 8/1989 | Talmadge | 364/464.02 |
| 4,917,010 | 4/1990 | Gilham et al. | 101/93.04 |
| 4,936,209 | 6/1990 | Diel | 101/93.01 |
| 5,104,245 | 4/1992 | Oguri et al. | 400/68 |
| 5,200,903 | 4/1993 | Gilham | 364/464.02 |
| 5,251,289 | 10/1993 | Fidler et al. | 395/112 |
| 5,283,744 | 2/1994 | Abumehdi et al. | 364/464.02 |
| 5,384,886 | 1/1995 | Rourke | 395/147 |
| 5,535,279 | 7/1996 | Seestrom | 380/55 |
| 5,602,977 | 2/1997 | Lee | 395/112 |
| 5,608,636 | 3/1997 | Guenther | 364/464.18 |
| 5,617,519 | 4/1997 | Herbert | 395/117 |
| 5,650,934 | 7/1997 | Manduley | 364/478.03 |
| 5,651,103 | 7/1997 | Arsenault et al. | 395/117 |

FOREIGN PATENT DOCUMENTS 2 282 566A 4/1995 United Kingdom .

*Primary Examiner*—Edward R. Cosimano

*Attorney, Agent, or Firm*—Steven J. Shapiro; Melvin J. Scolnick

[57] ABSTRACT

A postage metering system comprising: printing apparatus, the printing apparatus including structure for printing a postage indicia having a first portion including a postage value and a second portion including a town circle; accounting apparatus, the accounting including structure for accounting for the postage value, the accounting apparatus including structure for storing data descriptive of a bit mapped image of the second portion having a predetermined resolution, the accounting apparatus including structure for transferring the descriptive data to the printing apparatus; the printing apparatus including structure for requesting the postage value from the accounting apparatus and receiving therefrom the first portion and thus the postage value, the printing apparatus including structure for generating the bit mapped image of the second portion based on the descriptive data thereof, and the printing apparatus including structure for merging the first portion and bit mapped image of the second portion for printing the postage indicia and thus the postage value and town circle.

10 Claims, 3 Drawing Sheets

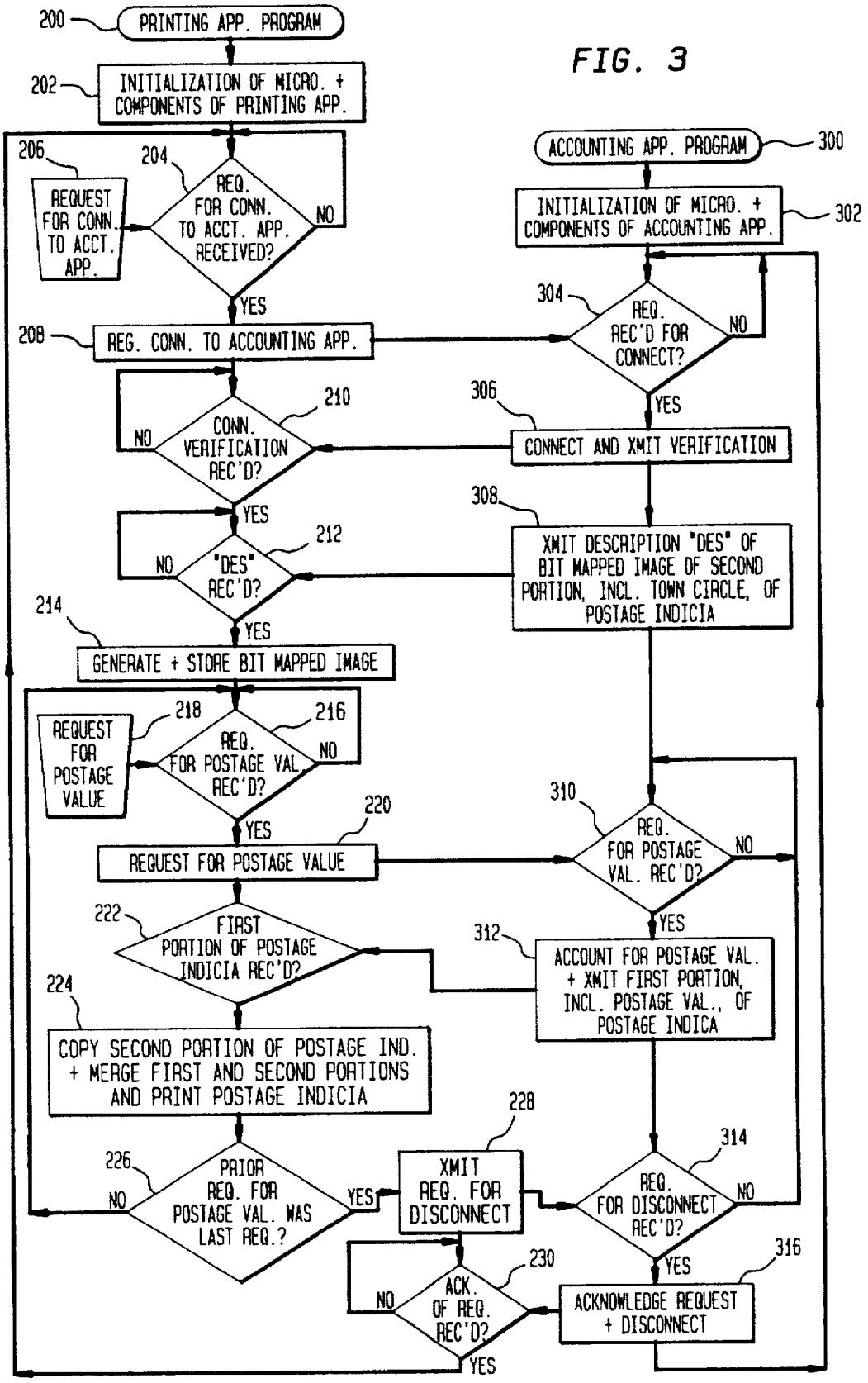
FIG. 3
200
PRINTING APP. PROGRAM
202
INITIALIZATION OF MICRO. + COMPONENTS OF PRINTING APP.
206
REQUEST FOR CONN. TO ACCT. APP.
204
REQ. FOR CONN. TO ACCT. APP. RECEIVED?
NO
YES
208
REG. CONN. TO ACCOUNTING APP.
210
CONN. VERIFICATION REC'D?
NO
YES
212
"DES" REC'D?
NO
YES
214
GENERATE + STORE BIT MAPPED IMAGE
218
REQUEST FOR POSTAGE VALUE
216
REQ. FOR POSTAGE VAL. REC'D?
NO
YES
220
REQUEST FOR POSTAGE VALUE
222
FIRST PORTION OF POSTAGE INDICIA REC'D?
224
COPY SECOND PORTION OF POSTAGE IND. + MERGE FIRST AND SECOND PORTIONS AND PRINT POSTAGE INDICIA
226
PRIOR REQ. FOR POSTAGE VAL. WAS LAST REQ.?
NO
YES
228
XMIT REQ. FOR DISCONNECT
230
ACK. OF REQ. REC'D?
NO
YES
ACCOUNTING APP. PROGRAM
300
INITIALIZATION OF MICRO. + COMPONENTS OF ACCOUNTING APP.
302
304
REQ. REC'D FOR CONNECT?
NO
YES
306
CONNECT AND XMIT VERIFICATION
308
XMIT DESCRIPTION "DES" OF BIT MAPPED IMAGE OF SECOND PORTION, INCL. TOWN CIRCLE, OF POSTAGE INDICIA
310
REQ. FOR POSTAGE VAL. REC'D?
NO
YES
312
ACCOUNT FOR POSTAGE VAL. + XMIT FIRST PORTION, INCL. POSTAGE VAL., OF POSTAGE INDICA
314
REQ. FOR DISCONNECT REC'D?
NO
YES
316
ACKNOWLEDGE REQUEST + DISCONNECT

POSTAGE METERING SYSTEM INCLUDING MEANS FOR CONTROLLING THE RESOLUTION OF PRINTING A PORTION OF A POSTAGE INDICIA

Background of the Invention

This invention is generally concerned with a postage metering system including means for controlling printing of a postage indicia and more particularly with a postage metering system having separate printing and accounting apparatus and including means for controlling the resolution of printing a portion of a postage indicia.

In the course of conducting a search concerning the subject matter of the present invention, the following references were found: U.S. Pat. No. 3,599,564 for a Print Control Device, issued Aug. 17, 1971 to Waibel; U.S. Pat. No. 4,936,209 for an Electronic Postage Meter With Zip Code Location Designation, issued Jun. 26, 1990 to Diel; and U.S. Pat. No. 5,384,886 for a Process For Electronically Printing Envelopes, issued Jan. 24 1995 to Rourke.

Of the foregoing references the '209 Patent to Diel is of interest in that it describes a prior art postage meter, which includes postage accounting structure, and includes a flat bed printer having a postal indicia die connected thereto, wherein the postal indicia includes an approved postal design part, and a value printing area and town circle part which are required to be printed by Postal Regulations.

In addition, the '886 Patent to Rourke is of interest, in that it describes an envelope printing system including separate image input, controller and printer sections, designated 4, 7 and 8, wherein the controller section 7 includes structure for permitting an operator to display a sample envelope template 160-2 to assist in programing an envelope for a printing job. The envelope template 106-2 has an electronic stamp field 186 which is described as being variable to permit the size of the field, and therefore the image data in the field, to be varied, and which may be filled in with an electronic stamp 258 in response to programing selections made by the operator.

On the other hand, the references are silent concerning a solution to the problem of controlling the resolution of printing a postage indicia, in a postage metering system which includes separate accounting and printing apparatus, wherein a proof-of-payment portion of the postage indicia is required by the Postal Service to be stored in the accounting apparatus, but wherein the printing apparatus has control over the resolution of printing the postage indicia. Accordingly:

an object of the invention is to provide a postage metering system including means for controlling the resolution of printing a portion of a postage indicia; and another object is to provide a postage metering system, having separate accounting and printing apparatus, wherein the accounting means includes means for controlling the resolution of printing a portion of the postage indicia including but not limited to the town circle.

SUMMARY OF THE INVENTION

A postage metering system comprising: printing apparatus, the printing apparatus including means for printing a postage indicia having a first portion including a postage value and a second portion including a town circle; accounting apparatus, the accounting including means for accounting for the postage value, the accounting apparatus including means for storing data descriptive of a bit mapped image of the second portion having a predetermined resolution, the accounting apparatus including means for transferring the descriptive data to the printing apparatus; the printing apparatus including means for requesting the postage value from the accounting apparatus and receiving therefrom the first portion and thus the postage value, the printing apparatus including means for generating the bit mapped image of the second portion based on the descriptive data thereof, and the printing apparatus including means for merging the first portion and bit mapped image of the second portion for printing the postage indicia and thus the postage value and town circle.

BRIEF DESCRIPTION OF THE DRAWINGS

As shown in the Drawings, wherein like reference numerals designate like or corresponding parts throughout the several views:

FIG. 3 is a flow chart of a process implemented by the accounting and printing apparatus for causing the printing apparatus to print a postage indicia.

DESCRIPTION OF THE PREFERRED EMBODIMENTS

Figure 1:
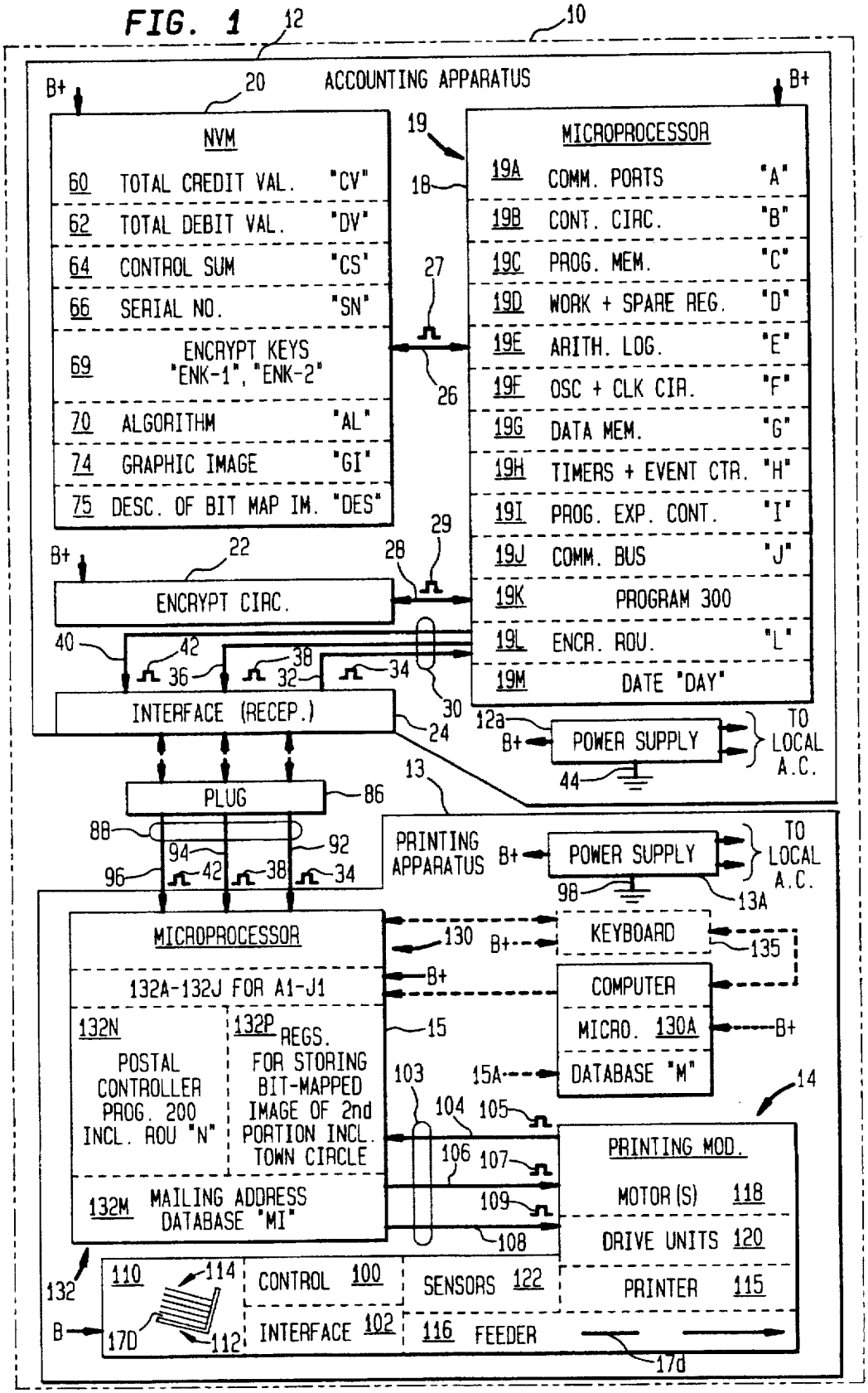
FIG. 1 is a schematic view of the postage metering system according to the invention, including secure value accounting apparatus and non-secure printing apparatus, wherein the accounting and printing apparatus are physically separated from each other and are respectively adapted to be electrically connected to each other.

As shown in FIG. 1, a postage metering system 10 according to the invention preferably comprises secure postage accounting apparatus 12, and non-secure printing apparatus 13, which are physically separated from each other. The accounting apparatus 12 includes a conventional D.C. power supply 12A having a ground 44. And the printing apparatus 13 includes a conventional D.C. power supply 13A including a ground 98. The power supplies 12A and 13A are respectively suitably adapted to be conventionally electrically connected to the same or different local A.C. source(s).

The printing apparatus 13 generally includes a non-secure printing module 14 and a non-secure local computer 15 therefor, for printing alphanumeric and graphic information 17 (FIG. 2), including but not limited to a postage indicia 17A on a sheet 17D, such as a letter, card or envelope, or the like, or such as a label or the like which is suitable for affixation to an article, to be mailed or shipped.

Figure 2:
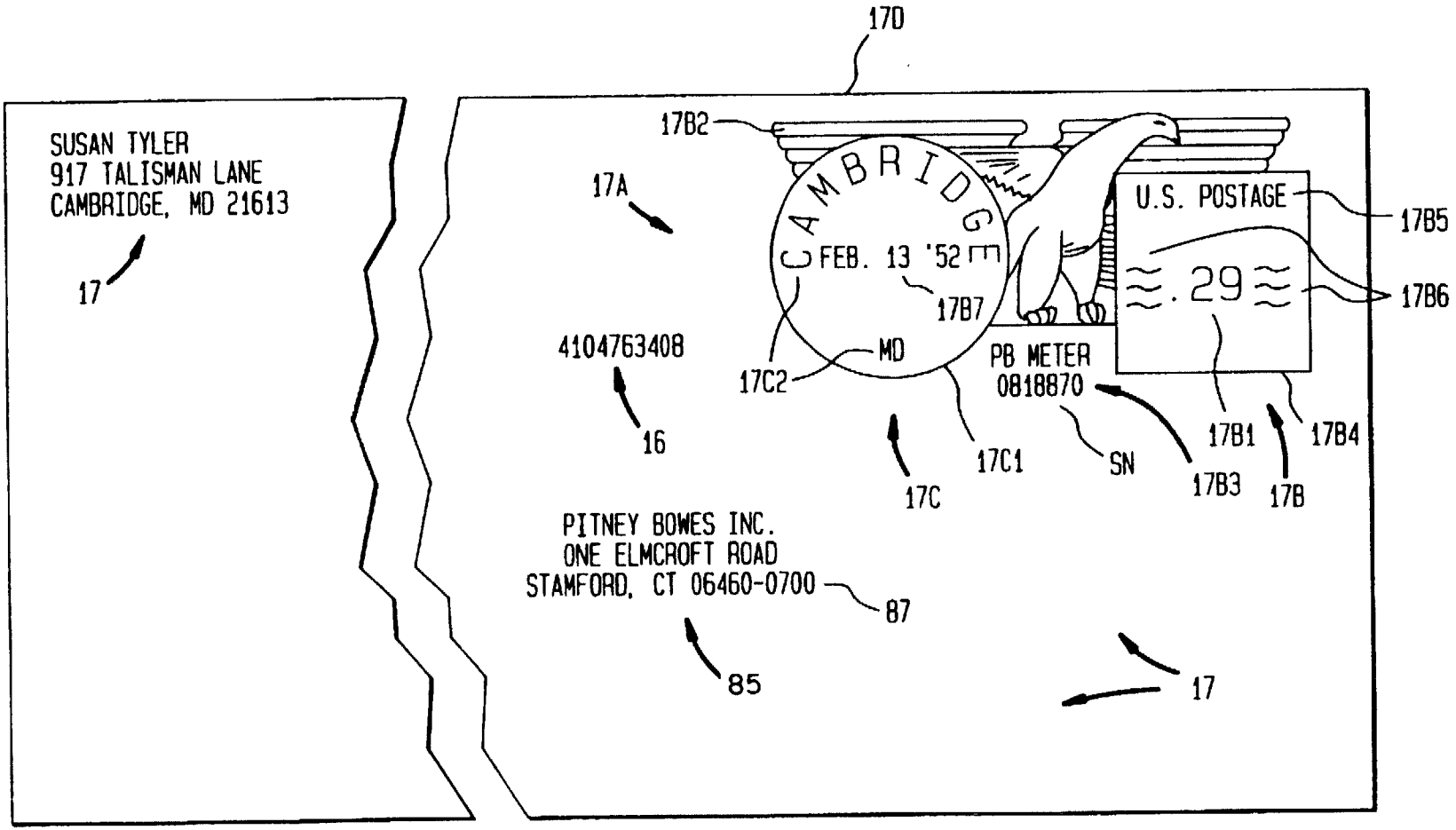
FIG. 2 is an elevation of an envelope having a postage indicia printed thereon by the non-secure printing apparatus in accordance with alphanumeric and graphic information received from the secure accounting apparatus.

The postage indicia 17A (FIG. 2) comprises a first alphanumeric and graphic information portion 17B, including a variable postage value 17B1. The first portion 17B may also include one or more fixed parts 17B2–17B6. Thus the first portion 17B may include a pictorial feature 17B2, such as a postage meter manufacturer's trademark, as exemplified by the pictorial representation of an eagle shown in FIG. 2, which is a registered trademark of Pitney Bowes Inc. Further, the first portion 17B may additionally include a fixed notation 17B3 identifying the manufacturer of the accounting apparatus 12 and the serial number of the apparatus 12, such as the notation "PB METER 081887" shown in FIG. 2. Moreover, as shown in FIG. 2, the first portion 17B may include a fixed pictorial representation of a square 17B4 having included therein the fixed notation "U.S.POSTAGE" 17B5, and on opposite sides of the postage value 17B1, the three, fixed, "wavy" lines known in the art as wings 17B6. In addition, the postage indicia 17A comprises a second alphanumeric and graphic information portion 17C, including a town circle 17C1. The town circle 17C1 includes a pictorial representation of a circle, having geographic location information 17C2 set forth therein, as exemplified by the location "CAMBRIDGE MD" shown in FIG. 2, or a code, such as the Postal Zip Code, corresponding thereto.

The postage accounting apparatus 12 (FIG. 1) generally includes a conventional microprocessor 18, and suitable non-volatile memory (NVM), encryption and interface structures, respectively designated 20, 22 and 24, which are conventionally connected to the microprocessor 18 and operable under the control thereof.

The microprocessor 18 (FIG. 1) may be any commercially available microprocessor including conventional structure 19, having a portion 19A thereof for providing a sufficient number of communications ports "A", including interrupts, which are either already available or are programmable for serial, parallel or asynchronous communications, as the case may be, to provide a separate communications link for respective internal components of the accounting apparatus 12 and for respective components, such as the printing apparatus 13, which are located externally of the accounting apparatus 12. Of course, without departing from the spirit and scope of the invention, the microprocessor 18 may include a plurality of microprocessors 18 to provide for additional communication ports "A" and other added capacities which may be called for in the course of implementation of the invention. Moreover, the microprocessor structure 19 includes a portion 19B thereof for providing a plurality of control circuits "B", a portion 19C thereof for providing program memory circuits "C", a portion 19D thereof for providing a plurality of working and spare register circuits "D", a portion 19E thereof for providing an arithmetic logic unit "E", a portion 19F thereof for providing circuits for one or more oscillators and clocks "F", a portion 19G thereof for providing data memory circuits "G", a portion 19H thereof for providing a plurality of timers and event counters "H", a portion 19I thereof for providing a program expansion control circuit "I", and a portion 19J thereof for providing an internal communications bus "J". Further, the microprocessor structure 19 includes a portion 19K thereof for storing an application program 300 for controlling the various operations of the accounting apparatus 12 discussed herein, and preferably includes a portion 19M for storing the current date 84.

The non-volatile memory structure (NVM) 20 (FIG. 1) is suitably electrically connected to the microprocessor 18 by means of a conventional communications link 26, extending from the microprocessor bus "J", for transmitting and receiving data signals, such as the signal 27, and synchronizing communications between the microprocessor 18 and NVM 20. In addition, the encryption structure 22 is suitably electrically connected to the microprocessor 18 by means of a conventional communications link 28, extending from the microprocessor bus "J", for transmitting and receiving data signals, such as the signal 29, and synchronizing communications between the microprocessor 18 and encryption structure 22. Moreover, the interface structure 24 is suitably electrically connected to the microprocessor 18 by means of a serial, parallel or asynchronous communications link, represented by the serial communications link 30, which includes a data input lead 32, for receiving data signals, such as the signal 34, from the printing apparatus 13, a data output lead 36, for providing data signals, such as the signal 38, to the printing apparatus 13, and a clock lead 40, for providing clock signals, such as the signal 42, to the printing apparatus 13 for synchronizing communications between the accounting apparatus 12 and printing apparatus 13.

The NVM 20 (FIG. 1) may be any commercially available non-volatile memory of the type which is suitable for use in a conventional postage meter for storing data which is critical to the operation of the meter and to guard against data access by the User and data losses due to power failures. Accordingly, the non-volatile memory (NVM) 20 includes conventional structure 60 for storing data corresponding to a current total credit value "CV", which is a total postage value currently available for printing, structure 62 for storing a current total debit value "DV", which is the total of all increments of postage value which have been decremented from total credit values "CV", structure 64 for storing a control sum "CS", which is the sum of the aforesaid credit and debit values, "CV" and "DV" and structure 66 for storing a serial number "SN" of the accounting apparatus 13. Moreover, the NVM 20 preferably includes structure 69 for storing a plurality of sequentially available, different, one-time-usage, first encryption key(s) "ENK-1", and for storing one or more second encryption keys "ENK-2", as hereinafter discussed in greater detail. Still further, the NVM 20 includes structure 70 for storing therein a conventional algorithm "AL" for causing the microprocessor 18 to implement appropriate steps for accounting for each increment 17B1 of the total postage or credit value "CV" which is provided to the printing apparatus 13 for printing thereby, including the steps of decrementing the total postage or credit value "CV" and incrementing the total debit value "DV" by an amount which is equal to each increment of postage value 17B1 (FIG. 2).

According to the invention, the NVM 20 (FIG. 1) also preferably includes structure 74 for storing data corresponding to a graphic image "GI" of the fixed parts 17B2–17B6 (FIG. 2) of the first portion 17B of the postage indicia 17A. Moreover, without departing from the spirit and scope of the invention, the graphic image "GI" (FIG. 1) may include a temporarily fixed portion of the postage indicia 17A (FIG. 2) such as the current date 17B7. In addition, according to the invention, the NVM 20 (FIG. 1) includes structure 75 for storing data corresponding to a description "DES" which is descriptive of a bit mapped image of predetermined resolution of the second portion 17C (FIG. 2), and thus the town circle 17C1 and, optionally, a geographic location 17C2, of the postage indicia 17A. Moreover, without departing from the spirit and scope of the invention, the description "DES" (FIG. 1) may optionally include one or more of the fixed parts 17B2–17B6 (FIG. 2) of the first portion 17B of the postage indicia 17A, and, to the extent that it does, the data corresponding to the graphic image "GI" (FIG. 1) need not include such fixed parts 17B2, 17B3, 17B4 17B5 or 17B6 (FIG. 2).

The encryption structure 22 (FIG. 1) is preferably conventionally operable under the control of the microprocessor 18 for decrypting and encrypting at least alphanumeric data, and, optionally, encrypting both alphanumeric and graphic data. As is well know in the art, the encryption structure 22 is operable for utilizing the next, sequentially available, encryption key "ENK-1", and one or more or all of the serial number "SN" of the accounting apparatus 12, the current total debit "DV" and control sum "CS", and the credit value "CV" and a requested postage value to be added thereto, for decrypting a code, received from a Data Center, which has embedded therein the requested postage value, and adding the requested postage value to the current credit value "CV" and recalculating the control sum "CS". In addition, the encryption structure 22 is operable for providing verifiable encrypted information 16 (FIG. 2) for printing by the printing apparatus 14. To that end, the encryption structure 22 is conventionally constructed and arranged for utilizing the second encryption key "ENK-2" for encrypting data corresponding to, for example, one or more of the numerical values stored in the NVM 20 or microprocessor 18, including the current date 17B7 (FIG. 2) current postage value 17B1 and a portion of the data corresponding to the mailing address 85, such as the zip code 87 thereof and, without departing from the spirit and scope of the invention, a portion of the data corresponding the graphic image "GI", aside from the current date 17B7. According to the invention, the encryption structure 22 may be a suitable electrical circuit which is located externally of the microprocessor 18, or an encryption routine "L" which is operable under the control of the program 300. Accordingly, the microprocessor structure 19 may include a portion 19L thereof for storing the encryption routine "L". Further, the encrypted information 16 is preferably included with the postage value 17B1, and thus with the first portion 17B of the postage indicia 17A when transferred from the accounting apparatus 12 to the printing apparatus 13.

As noted above, the encrypted information 16 (FIG. 2), as printed on the envelope 17D, is characterized as being "verifiable". In this connection it is noted that assuming the Postal Service has a computer having stored therein the program "L" and the encryption keys "ENK-2", then, the plain text alphanumeric and graphic information on the face of the envelope 17D which is encrypted by the microprocessor 18 may be read from the envelope 17D and encrypted by the Postal Service computer to produce encrypted information which may then be compared to the encrypted information 16 printed on the envelope 17D, in order to verify that they are the same, whereby the relationship between the selected plain text and encrypted versions thereof which are printed on the envelope 17D be may be authenticated.

The interface structure 24 (FIG. 1) is preferably a conventional electrical receptacle, which is suitably constructed and arranged for receiving an electrical plug 86 of a two-way serial, parallel or asynchronous communications link, represented by the link 88, extending from the control structure 15 of the printing apparatus 13. The communications link 88 includes a data output lead 92, for providing data signals, such as the signal 34, to the microprocessor 18, a data input lead 94, for receiving data signals, such as the signal 38, from the microprocessor 18 and a clock lead 96, for receiving clock signals, such as the signal 42, from the microprocessor 18 for synchronizing communications between the accounting apparatus 12 and printing apparatus 13.

The printing module 14 (FIG. 1) is preferably a conventional, standalone, device, which includes suitable structure 100, such as a microprocessor, for controlling the various structures and functions of the module 14. The printing module 14 may include a conventional operator interface 102, such as a suitable keyboard, which is conventionally coupled to the control structure 100 for providing input signals thereto in response to actuation of the keyboard. Whether or not the printing module 14 includes an operator interface 102, the control structure 100 is preferably conventionally adapted to include a two-way serial, parallel or asynchronous communications link, represented by the serial communications link 103, for conventionally coupling the control structure 100 to an external source, such as the non-secure local computer 15. The communications link 103 includes a data output lead 104, for providing data signals, such the signal 105, to the local computer 15, a data input lead 106, for receiving data signals, such as the signal 107, from the local computer 15, and a clock lead 108, for receiving clock signals, such as the signal 109, from the local computer 15 for synchronizing communications between the local computer 15 and printing module 14. Thus the printing module 14 is preferably adapted to permit control of the structures and functions thereof from the local computer 15 rather than from the operator interface 102.

The printing module 14 (FIG. 1) may additionally include conventional sheet stacking structure 110, such as a suitable hopper 112 into which a stack 114 of sheets 17D, may be loaded. The printing module 14 also includes conventional printing structure 115, such as any conventional thermal, ink jet, laser or like commercially available printing structure for printing alphanumeric and graphic information on respective sheets 17D. In addition, the printing module 14 may include conventional sheet feeding structure 116 which is suitably electrically connected to and operable under the control of the control structure 100. Further, assuming the provision of the sheet stacking and feeding structures, 110 and 116, the feeding structure 116 may be any conventional vacuum or roller type structure for sequentially engaging the respective top or bottom sheet 17D in the stack 114 and feeding the respective sheets 17D from the hopper 112 to the printing structure 115, and, thereafter for sequentially feeding such sheets 17D from the printing module 14, and thus from the printing apparatus 13. Of course, assuming the sheet stacking structure 110 was not provided, such sheets 17D could be manually fed, either to the sheet feeding structure 116, for feeding thereby to and from the printing structure 115, or to the printing structure 115, for feeding therefrom by the sheet feeding structure 116. And, assuming both the sheet stacking and feeding structures, 110 and 116, were not provided, such sheets 17D could be manually inserted into and withdrawn from the printing structure 115.

In any event, assuming the provision of the sheet feeding structure 116 (FIG. 1) alone or in combination with the sheet stacking structure 110, the printing module 14 preferably includes a suitable motor 118, which is connected to and operable under the control of the control structure 100. In addition, the printing module 14 would preferably include one or more drive units 120, which are respectively connected between the motor 118 and feeding structure 116. Moreover, the printing module 14 would preferably include a plurality of conventional sensors 122, for sensing various positions of respective sheets 17D and of selected elements of the feeding structure 116, motor 118 and drive units 120 including their respective home positions, at selected time intervals and providing relevant, analog, electrical signals to the control structure 100. Moreover, the control structure 100 would preferably be conventionally constructed arranged, for providing digital signals, such as the signal 105, to the local computer 15, which correspond to the various positions of respective sheets 17D and to selected elements of the feeding structure 116, motor 118 and drive units 120, at selected time intervals.

Although the non-secure local computer 15 (FIG. 1) may be any conventional, commercially available, computer, such as a conventional microprocessor, controller or personal computer, the local computer 15 preferably comprises a microprocessor 130 having conventional structure 132, including respective portions 132A–132J thereof for providing a plurality of circuits, stored data and programs, A1–J1 inclusive, which respectively correspond in all respects to the circuits, stored data and programs, A–J inclusive, of the microprocessor 18. In addition, the structure 132 may include a portion 132M thereof for storing a mailing address database "M" and a portion 132N thereof for storing a postal controller program 200 including a conventional routine "N" thereof for calling up and accessing respective mailing addresses 85 (FIG. 2). Moreover, according to the invention, the structure 132 preferably includes a portion 132P thereof which includes a plurality of registers for storing the bit-mapped image of the second portion 17C of the postage indicia 17A including the town circle 17C1. Further, without departing from the spirit and scope of the invention, rather than, or in addition to, the printing module 14 including control structure 100, the local computer 15 may include a keyboard 135 for manually entering information concerning respective mailruns into the printing apparatus 13 under the control of the microprocessor 130. Moreover, without departing from the spirit and scope of the invention, the local computer 15 may be a first computer 15, and the printing apparatus 13 may include a second computer 15A which is conventionally connected in communication with the first computer 15, but wherein the second computer 15A, rather than the first computer 15, includes structure 132M, having the mailing address database "M" stored therein and includes the keyboard 135 and microprocessor 130A, but does not include microprocessor 130 or the postal controller program 200.

According to the invention, the postal controller program 200 (FIG. 3) is constructed and arranged for initiating the establishment of communications between the printing and accounting apparatus 12 and 13, followed by receiving data corresponding to a description "DES", which is descriptive of a bit mapped graphic image having a predetermined resolution of the second portion 17C of the postage indicia 17A, and thus of the town circle 17C1. Moreover, the postal controller program 200 is constructed and arranged for thereafter generating, and storing in the microprocessor 132 in the registers 132P, the bit-mapped image of predetermined resolution of the second portion 17C of the postage indicia 17A, based on the description "DES" received from the accounting apparatus 12. In addition, according to the invention, the postal controller program 200 is constructed and arranged for causing the printing apparatus 13 to sequentially request data corresponding to respective increments of postage value from the accounting apparatus 12 and sequentially receive therefrom respective first portions 17B of the postage indicia 17A, and thus the respective increments of postage value 17B. And, the program 200 is constructed and arranged for causing the printing apparatus 13 to sequentially merge each first portion 17B of the postage indicia 17A and a copy of the bit mapped image of the second portion 17C thereof, followed by causing the printing apparatus 13 to print the merged portions, 17B and 17C, and thus a postage indicia 17A including the town circle 17C1 and requested postage value 17B1.

Assuming connection of the accounting and printing apparatus, 12 and 13 (FIG. 1), and thus the postage metering system 10, to an external A.C. source, the accounting and printing apparatus, 12 and 13, would be conventionally energized. Whereupon, as shown in FIG. 3, the printing apparatus program 200 causes the computer 15 (FIG. 1) to implement the step 202 (FIG. 3) of initializing the computer 15 (FIG. 1) and the other components of the printing apparatus 13, and, concurrently, the accounting apparatus program 300 (FIG. 3) causes the microprocessor 18 (FIG. 1) to implement the step 302 of initialization of the microprocessor 18 (FIG. 1) and other components of the accounting apparatus 12. Thereafter, the printing apparatus program 200 (FIG. 3) initially causes the computer 15 (FIG. 1) to implement the step 204 of inquiring whether a manual or other input request, 206, has been received, step 204, for removably electrically connecting the accounting and printing apparatus, 12 and 13 (FIG. 1), in communication with each other. Thus, the printing apparatus program 200 (FIG. 3) is constructed and arranged to include conventional means for initiating establishment of a semi-permanent or communication connection between the accounting and printing apparatus, 12 and 13 (FIG. 1), to permit the printing apparatus 13 to be used for the purposes of printing respective postage values (FIG. 2) alone or in combination with processing sheets 17D for mailing.

Assuming a request to establish a communication connection has not been received, step 204, then, the program 200 causes the computer 15 to continuously loop through step 204 until the communication connection request 206 is received, step 204. Whereupon, the program 200 causes implementation of the step 208 of requesting that the accounting apparatus 12 establish the communication connection with the printing apparatus 13, followed by the step 210 of inquiring whether a verification of establishment of the communication connection has been received from the accounting apparatus 12, failing which, the program 200 causes the computer 15 to continuously loop through step 210 until the acknowledgment is received. On the other hand, the accounting module program 300 initially causes the microprocessor 18 to implement the step 304 of inquiring whether an communications connection request, 208, has been received, step 304, from the printing apparatus 13, and, assuming that it has not, step 304, then, the program 300 causes the microprocessor 18 to continuously loop through step 304, until the request 208 is received, step 302.

When the accounting apparatus 12 (FIG. 1) receives the communications connection request, step 304 (FIG. 3), the program 300 causes the microprocessor 18 to implement the step 306 of establishing the connection and transmitting a verification message thereof to the printing apparatus 13. Whereupon the program 200 causes the computer 15 to implement the step 212 of determining whether the printing apparatus 13 has received data corresponding to a description "DES", of a bit mapped image of predetermined resolution of the second portion of the postage indicia, and, assuming that it has not, step 212, causes the computer to continuously loop through step 212, until the data corresponding to the description "DES" is received, step 212. On the other hand, following transmission to the printing apparatus 13 of the communication connection verification message, step 306, the accounting apparatus program 300 causes the microprocessor 18 to implement the step 308 of transmitting to the printing apparatus 13 the data corresponding to the description "DES", stored in the microprocessor 18, which is descriptive of the bit mapped image of predetermined resolution of the second portion 17C of the postage indicia 17A, including the town circle 17C1.

When the printing apparatus 13 (FIG. 1) receives the description "DES", step 212, the program 200 causes the computer 15 to implement the step 214 of generating the bit mapped image of predetermined resolution of the second portion 17C of the postage indicia 17A, including the town circle 17C1, based on the description "DES". Preferably, step 214 includes the step of storing the bit mapped image in the printing apparatus 13, and, in particular, in a predetermined non-volatile memory NVM portion 132P of the computer 15. Assuming the prior storage in the NVM portion 132P of bit mapped image, then, the currently stored bit mapped image preferably replaces the prior bit mapped image. As thus contructed and arranged, the currently stored bit mapped image would replace a prior bit mapped image, if based on a different description "DES", as would be the case if the printing apparatus 13 was previously located in a different geographic location or the content of the description "DES" was changed, or if based on the same description "DES", as would be the case if the printing apparatus 13 had been previously connected to the accounting apparatus 12, to ensure the continuous refreshment of the currently stored bit mapped image.

Thus, the printing apparatus 13 (FIG. 1) receives data corresponding to a description "DES" of the second portion 17C (FIG. 2) of the postage indicia 17C, including the town circle 17C1, as a result of the printing apparatus 13 (FIG. 1) having had entered thereinto a request to be connected to the accounting apparatus 13, and thus before the printing apparatus 13 has made a request to the accounting apparatus 12 for a postage value 17B1 (FIG. 2) to be printed. Moreover, before a request for a postage value 17B1 is made, the printing apparatus 13 (FIG. 1) has generated and stored therein the bit mapped image of predetermined resolution of the second portion 17C (FIG. 2) of the postage indicia 17A, and thus a bit mapped image of predetermined resolution of a town circle 17C1. Accordingly, although the printing apparatus 13 has control of printing the postage indicia's town circle 17C1, the resolution thereof has been predetermined by the accounting apparatus 12.

As shown in FIG. 3, subsequent to the accounting apparatus 12 transmitting the description "DES" of the second portion of the postage indicia to the printing apparatus 13, step 308, the accounting apparatus program 300 causes the microprocessor 18 to implement the step 310 of determining whether a request for an increment of the total postage or credit value "CV", as exemplified by the postage value 17B1 (FIG. 2), has been received from the printing apparatus 13, and, assuming that it has not, the program 300 causes the microprocessor 18 to continuously loop through step 310, until a postage value request 310 is received. On the other hand, subsequent to the printing apparatus 13 generating and storing therein the bit mapped image of the second portion 17C of the postage indicia 17A based on the description "DES", step 214, the printing apparatus program 200 causes the computer 15 to implement the step 216 of determining whether a manual or other input request, step 218, for an increment 17B1 of the total postage or credit value "CV", as exemplified by the postage value 17B1 (FIG. 2), has been received by the printing apparatus 13, and, assuming that it has not, the program 200 causes the computer 15 to continuously loop through step 216, until a postage value request 218 is received. Without departing from the spirit and scope of the invention, the step 218 may include a request for a plurality of increments 17B1 of the total credit value "CV" to accomodate a processing a predetermined plurality of letters of a batch of mail, in which instance the number of letters of the batch and total postage amount to be used would be included with the request for accounting purposes.

Assuming that a postage value request, step 218 (FIG. 3), is received by the printing apparatus 13, step 216, the printing apparatus program 200 causes the computer 15 to implement the step 220 of transmitting a request to the accounting apparatus 12 for the requested postage value 17B1, followed by the step 222 of determining whether the printing apparatus 13 has received from the accounting apparatus 12 a first portion 17B of the postage indicia 17A, including the requested postage value 17B1. And, when the postage value request, step 220, from the printing apparatus 13 is received by the accounting apparatus 12, step 310, the accounting apparatus program 300 causes the microprocessor 18 to implement the step 312 of accounting for the increment 17B1 of the total postage credit value "CV" that is to be transmitted to the printing apparatus 13 for printing thereby, by decrementing the credit value "CV" and Incrementing the debit value "DV" by an amount corresponding to the postage value 17B1. Preferably the accounting step 312 includes the step of transmitting to the printing apparatus 13, data corresponding to a first portion 17B of the postage indicia 17A, including the postage value 17B1, for printing thereby.

Assuming the transmission by accounting apparatus 12 (FIG. 1) of the postage indicia's first portion 17B, step 312 (FIG. 3) is received by the printing apparatus 13, step 222, then, the printing apparatus program 200 causes the computer 15 to implement the step 224 of fetching and making a copy of the stored second portion 17C of the postage indicia 17A, including the town circle 17C1 having the geographic location 17C2, followed by merging the data corresponding to the postage indicia's first portion 17B and the copy of the postage indicia's second portion 17C with one another, and printing the merged data corresponding to the postage indicia 17A, and thus the town circle 17C1 and postage value 17B1.

Assuming the postage indicia 17A (FIG. 2) has been printed step 224 (FIG. 3), the printing apparatus program 200 then causes the computer to implement the step 226 of determining whether the prior postage value request 218 was the last, or final, request. Assuming that the inquiry of step 226 is negatively answered, then the program 200 causes processing to be returned to step 216 to await the next postage value request. Without departing from the spirit and scope of the invention, assuming the postage value request of step 218 was a request for a plurality of postage increments 17B1 for a predetermined number of letters of a batch thereof to be mailed, then, step 218 may include the step of starting a counter to count the letters of the batch and provide an affirmative response to the inquiry of step 226 when the counter counts the last letter of the batch. Further, without departing from the spirit and scope of the invention, the inquiry of step 226 may include the step of starting a timer to count a predetermined time period before the inquiry of step 226 is automatically affirmative answered, but during which time period the inquiry of step 226 will always be negatively answered, to give the operator of the printing apparatus 13 the predetermined time period for making the next postage value request 218. In any event, assuming the inquiry of step 226 is affirmatively answered, that is, the prior postage value request 218 is the last request, then, the printing apparatus program 200 causes the computer 15 to implement the step 228 of transmitting a disconnect request to the accounting apparatus 12, followed by the step 230 of determining whether the accounting apparatus 12 has acknowledged that the disconnect request 228 has been received, step 230.

Referring back to step 312 (FIG. 3), subsequent to transmitting the postage indicia's first portion 17B, and thus the requested postage value 17B1, to the printing apparatus 13, the accounting apparatus program 12 causes the microprocessor 18 to implement the step 314 of determining whether the accounting apparatus 12 has received a request from the printing apparatus 13 for disconnection therefrom, and assuming that is has not, the program 300 causes the microprocessor 18 to return processing to step 310 to await the next postage value request from the printing apparatus 13. On the other hand, assuming a disconnect request 228 is received from the printing apparatus 13, step 314, then the accounting apparatus program 300 causes the microprocessor 18 to implement the step 316 of transmitting to the printing apparatus 13 a message acknowledging the disconnect request 228, and then disconnecting the accounting apparatus 12 from communication with the printing apparatus and returning processing to step 304 to await the next connection request 208 which is received, step 304, from the printing apparatus 13. Similarly, when the disconnection request acknowledgment 316 is received by the printing apparatus 13 step 230, the printing apparatus program 200 causes the computer 15 to return processing to step 204 to await the next connection request 206 which is received, step 204, as input to the printing apparatus 13.

What is claimed is:

1. A postage metering system comprising:

(a) printing apparatus, the printing apparatus including means for printing a postage indicia having a first portion including a postage value and a second portion including a town circle;

(b) accounting apparatus, the accounting apparatus including means for accounting for the postage value, the accounting apparatus including means for storing data descriptive of a bit mapped image of the second portion having a predetermined resolution, the accounting apparatus including means for transferring the descriptive data to the printing apparatus;

(c) the printing apparatus including means for requesting the postage value from the accounting apparatus and receiving therefrom the first portion and thus the postage value, the printing apparatus including means for generating the bit mapped image of the second portion based on the descriptive data thereof, and the printing apparatus including means for merging the first portion and the bit mapped image of the second portion for printing the postage indicia and thus the postage value and town circle.

2. The postage metering system according to claim 1, wherein first portion of the postage indicia includes first graphic information, and the first graphic information includes a pictorial feature.

3. The postage metering system according to claim 1, wherein the second portion of the postage indicia includes second graphic information, and said second graphic information includes the town circle.

4. The postage metering system according to claim 1, wherein the printing and accounting apparatus are removably electrically connectable to each other, the printing apparatus including means for initiating establishment of communications between the printing and accounting apparatus, and wherein the transferring means transfers the descriptive data from the accounting apparatus to the printing apparatus upon completion of establishment of communications therebetween.

5. The postage metering system according to claim 4, wherein the printing means includes means for storing the bit mapped image, and the merging means merging a copy of the stored bit mapped image and thus the bit mapped image.

6. The postage metering system according to claim 1, wherein the first portion of the postage indicia includes first alphanumeric information, and the first alphanumeric information includes the postage value.

7. The postage metering system according to claim 6, wherein the first alphanumeric information includes a serial number of the accounting apparatus.

8. The postage metering system according to claim 1, wherein the second portion of the postage indicia includes second alphanumeric information, and the second alphanumeric information includes information corresponding to a geographic location.

9. The postage metering system according to claim 8, wherein the geographic location information includes a code.

10. A postage metering system comprising:

(a) printing apparatus, the printing apparatus including means for sequentially printing respective postage indicia respectively having a first portion including an increment of a total postage value and a second portion including a town circle;

(b) accounting apparatus, the accounting apparatus including means for storing a total postage value, the accounting apparatus including means for storing data descriptive of a bit mapped image of the second portion having a predetermined resolution, the accounting apparatus including means for transferring the descriptive data to the printing apparatus;

(c) the printing apparatus including means for sequentially requesting from the accounting apparatus respective increments of the total postage value, the accounting apparatus including means for sequentially accounting for the respective increments, the accounting means including means for sequentially providing the printing apparatus with respective first portions of the postage indicia and thus the respective increments, the printing apparatus including means for generating and storing the bit mapped image of the second portion based on the descriptive data thereof, and the printing apparatus including means for sequentially merging respective first portions and respective copies of the bit mapped image of the second portion for sequentially printing respective postage indicia and thus the respective increments of the total postage value and the town circle.

* * * * *